US007922482B2

(12) United States Patent
Kubicek et al.

(10) Patent No.: US 7,922,482 B2
(45) Date of Patent: Apr. 12, 2011

(54) CANDLE AND WICK HOLDER THEREFOR

(75) Inventors: Chris A. Kubicek, East Troy, WI (US); Paul E. Furner, Racine, WI (US); Mary Beth Adams, Antioch, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 1066 days.

(21) Appl. No.: 11/529,080

(22) Filed: Sep. 28, 2006

(65) Prior Publication Data

US 2007/0026352 A1 Feb. 1, 2007

Related U.S. Application Data

(63) Continuation-in-part of application No. 10/780,028, filed on Feb. 17, 2004, now Pat. No. 7,247,017, which is a continuation-in-part of application No. 09/747,525, filed on Dec. 20, 2000, now Pat. No. 6,802,707, application No. 11/529,080, which is a continuation-in-part of application No. 10/978,744, filed on Nov. 1, 2004, now Pat. No. 7,229,280, which is a continuation-in-part of application No. 10/938,434, filed on Sep. 10, 2004, now Pat. No. 7,524,187.

(51) Int. Cl.
*F23D 3/16* (2006.01)

(52) U.S. Cl. ..... 431/291; 431/288; 431/289; 431/292; 431/298

(58) Field of Classification Search ..... 431/288, 431/289, 292, 294, 325
See application file for complete search history.

(56) References Cited

U.S. PATENT DOCUMENTS

| | | | |
|---|---|---|---|
| 213,184 | A | 3/1879 | Frick |
| 397,011 | A | 1/1889 | Leynen-Hougaerts |
| 405,786 | A | 6/1889 | Ludde |

(Continued)

FOREIGN PATENT DOCUMENTS

| | | |
|---|---|---|
| CA | 2208145 | 12/1998 |

(Continued)

OTHER PUBLICATIONS

PCT Intl. Search Report and Written Opinion dated Dec. 6, 2006, Appl. No. PCT-US2006-028221.

(Continued)

*Primary Examiner* — Kenneth B Rinehart
*Assistant Examiner* — Daniel A Bernstein

(57) ABSTRACT

The present invention relates to melting plate candles that employ heat conductive materials to distribute heat from a burning flame at a wick to a plate for melting a meltable fuel. Such melting plate candles more rapidly liquefy the meltable fuel, such as paraffin wax. Further, such melting plate candles more uniformly and intensely heat the meltable fuel thereby increasing the efficiency of consumption thereof and more rapidly releasing volatile materials contained within the fuel. The heat conductive plate is configured so as to have a capillary recess or a capillary pedestal upon the surface thereof, which cooperatively engages a wick holder assembly comprising a wick and a heat conductive fin that conducts heat from a flame upon the wick to the plate. The wick holder further engages the fuel and the plate so as to cause the flow of liquefied fuel to the wick. The fuel may be provided in various forms, configured to cooperatively engage the wick holder and plate, and may comprise various volatile materials. The capillary recess or pedestal, in conjunction with the wick holder, causes rapid and complete flow of the liquefied fuel to the wick.

15 Claims, 8 Drawing Sheets

U.S. PATENT DOCUMENTS 484,210 A 10/1892 Ludde
534,990 A 3/1895 Baumer
574,376 A 1/1897 Baumer
1,044,256 A 11/1912 Satter
1,174,934 A 3/1916 Hawkins et al.
1,195,657 A 8/1916 Chersky
1,226,850 A 5/1917 Booty
1,267,968 A 5/1918 Bulle
1,299,977 A 4/1919 McGuire
1,309,545 A 7/1919 Reicher
1,320,109 A 10/1919 Wooster
1,336,635 A 4/1920 Knapp
1,344,446 A 6/1920 Engman
1,345,960 A 7/1920 Rosenberger
1,390,389 A 9/1921 Rosenfeld
1,484,964 A 2/1924 Rhoads
1,660,760 A 12/1925 Murphy
D83,100 S 1/1931 Gisolfi
1,867,420 A 7/1932 Root
1,961,629 A 6/1934 Bolser
2,001,312 A 5/1935 O'Connell
2,137,701 A 11/1938 Replogle
2,240,071 A 4/1941 Gisolfi
2,246,346 A 6/1941 Carroll
2,254,906 A 9/1941 Petrulis
2,274,823 A 3/1942 Candy, Jr.
2,291,067 A 7/1942 Atkins
2,324,753 A 7/1943 Alexiade
2,462,440 A 2/1949 Tierney
2,481,019 A 9/1949 Joyce
2,533,290 A 12/1950 Shaw
2,758,460 A 8/1956 Ciano
2,809,512 A 10/1957 Hartnett
RE24,423 E 2/1958 Oesterle et al.
3,045,855 A 7/1962 Lipman
3,121,316 A 2/1964 Wilson
3,183,688 A 5/1965 Sobelson
3,286,492 A 11/1966 Frazier
D206,946 S 2/1967 Knodt
3,330,132 A 7/1967 Dick et al.
3,462,235 A 8/1969 Summers
3,466,135 A 9/1969 Summers
3,583,853 A 6/1971 Schramm
3,689,616 A * 9/1972 Kelley ..... 264/68
3,730,674 A * 5/1973 Gross ..... 431/288
D229,852 S 1/1974 Lindblad
3,790,332 A 2/1974 Woollard
3,797,990 A 3/1974 Rogers et al.
3,831,899 A 8/1974 Doig
3,873,263 A 3/1975 DeCroix
3,890,085 A * 6/1975 Andeweg ..... 431/125
3,898,039 A 8/1975 Lin
3,910,753 A * 10/1975 Lee ..... 431/290
4,013,397 A 3/1977 Neugart
4,019,856 A 4/1977 Lacroix
D248,500 S 7/1978 Ulrich et al.
4,102,634 A 7/1978 Crisp
4,134,718 A 1/1979 Kayfetz et al.
4,185,953 A 1/1980 Schirneker
4,206,500 A 6/1980 Neil
4,234,303 A 11/1980 Neugart
D264,385 S 5/1982 Meyer
4,332,548 A 6/1982 Linton et al.
4,381,914 A 5/1983 Ferguson
4,427,366 A 1/1984 Moore
4,494,926 A 1/1985 Riha
4,557,687 A 12/1985 Schirneker
4,611,986 A 9/1986 Menter et al.
4,755,135 A 7/1988 Kwok
4,804,323 A 2/1989 Kim
4,878,832 A 11/1989 Lynch
5,078,591 A 1/1992 Depres
5,078,945 A 1/1992 Byron
5,193,994 A 3/1993 Schirneker
5,338,187 A 8/1994 Elharar
5,363,590 A 11/1994 Lee
D355,266 S 2/1995 Caplette et al.
5,425,633 A * 6/1995 Cole ..... 431/291
5,651,669 A 7/1997 Henry
5,690,484 A 11/1997 Leonard et al.
5,697,694 A 12/1997 Cutts
5,807,096 A 9/1998 Shin et al.
5,842,850 A * 12/1998 Pappas ..... 431/291
5,911,955 A 6/1999 Fullam
5,921,767 A 7/1999 Song
5,939,005 A 8/1999 Materna
5,951,278 A 9/1999 Young et al.
D415,295 S 10/1999 Kochis et al.
5,961,318 A 10/1999 Chambers et al.
5,980,241 A 11/1999 Schirneker
6,019,804 A 2/2000 Requejo et al.
6,033,209 A 3/2000 Shin et al.
6,033,210 A 3/2000 Freeman
6,050,812 A 4/2000 Chuang
6,059,564 A 5/2000 Morris
6,062,847 A 5/2000 Pappas
6,068,472 A 5/2000 Freeman et al.
6,074,199 A 6/2000 Song
6,079,975 A 6/2000 Conover
6,129,771 A 10/2000 Ficke et al.
6,214,063 B1 4/2001 DeStefano et al.
6,241,512 B1 6/2001 Freeman et al.
6,241,513 B1 6/2001 Jeneral
6,276,925 B1 8/2001 Varga
6,290,489 B1 9/2001 Seidler
6,296,477 B1 10/2001 Lin
6,328,935 B1 12/2001 Buccellato
6,361,311 B1 * 3/2002 Smith ..... 431/291
6,371,756 B1 4/2002 Toohey
6,375,455 B2 4/2002 Frandsen et al.
6,398,544 B2 * 6/2002 Wright et al. ..... 431/291
6,428,311 B1 8/2002 Bernardo
6,435,694 B1 8/2002 Bell et al.
6,444,156 B1 9/2002 Schwarz et al.
6,454,561 B1 9/2002 Colthar et al.
6,520,770 B2 2/2003 Zou
6,537,063 B1 3/2003 Pecoskie
6,543,268 B2 4/2003 Wright et al.
6,544,302 B2 4/2003 Berger et al.
6,551,365 B2 4/2003 Berger et al.
6,568,934 B1 5/2003 Butler
6,579,089 B1 6/2003 Iu
6,592,363 B2 * 7/2003 Hoffmann ..... 431/320
6,595,771 B2 7/2003 Chu
6,648,631 B2 11/2003 Wright et al.
6,688,880 B1 2/2004 Pangle
6,695,611 B2 2/2004 Lee
6,702,573 B2 3/2004 Massey
6,716,026 B1 4/2004 Beougher
6,730,137 B2 5/2004 Pesu et al.
6,776,968 B2 8/2004 Edwards et al.
6,780,382 B2 8/2004 Furner et al.
6,793,484 B2 9/2004 Pesu et al.
6,799,965 B1 10/2004 Gaudioso
6,802,707 B2 10/2004 Furner
6,857,869 B1 * 2/2005 Sun ..... 431/289
6,863,525 B2 3/2005 Byrd
6,923,639 B2 8/2005 Pesu et al.
7,014,819 B2 3/2006 Hart et al.
7,086,752 B1 8/2006 Feuer
7,467,945 B2 12/2008 Kubicek et al.
2001/0031438 A1 10/2001 Hannington et al.
2003/0027091 A1 2/2003 Brandt
2003/0064336 A1 4/2003 Welch
2003/0064340 A1 * 4/2003 Pappas ..... 431/298
2003/0104330 A1 6/2003 Joyner
2003/0134246 A1 7/2003 Gray et al.
2004/0029061 A1 2/2004 Dibnah et al.
2004/0033463 A1 2/2004 Pesu et al.
2004/0229180 A1 11/2004 Furner
2005/0037308 A1 2/2005 Decker
2005/0164141 A1 7/2005 Paasch et al.
2005/0214704 A1 9/2005 Pappas et al.
2005/0227190 A1 10/2005 Pappas
2005/0239010 A1 10/2005 Duska et al.
2006/0057529 A1 3/2006 Kubicek et al.

| | | | |
|---|---|---|---|
| 2006/0084021 | A1 | 4/2006 | Kubicek |
| 2006/0183065 | A1 | 8/2006 | Konkle, Jr. |
| 2007/0275336 | A1 | 11/2007 | Sun |

FOREIGN PATENT DOCUMENTS

| | | |
|---|---|---|
| DE | 24 40 068 | 3/1976 |
| DE | 27 06 103 | 8/1978 |
| DE | 3302591 | 8/1984 |
| DE | 3403604 | 8/1985 |
| DE | 39 18 591 | 9/1990 |
| DE | 4203644 | 8/1993 |
| DE | 4241292 | 5/1994 |
| DE | 004 337 397 | 5/1995 |
| DE | 4425179 | 1/1996 |
| DE | 19508962 | 9/1996 |
| DE | 19548958 | 12/1996 |
| DE | 198 06 404 | 9/1998 |
| DE | 102004011919 | 6/2005 |
| EP | 0 149 149 | 7/1985 |
| EP | 1 336 799 | 8/2003 |
| GB | 161342 | 4/1921 |
| GB | 1514338 | 6/1978 |
| GB | 2 080 514 | 2/1983 |
| JP | 08-157864 | 6/1996 |
| JP | 09-302998 | 11/1997 |
| WO | WO92-08776 | 5/1992 |
| WO | WO 95-12783 | 5/1995 |
| WO | WO95-16876 | 6/1995 |
| WO | WO 95-24588 | 9/1995 |
| WO | WO96-21124 | 7/1996 |
| WO | WO 2004-083349 | 9/2004 |
| WO | WO 2006-031669 | 3/2006 |

OTHER PUBLICATIONS

PCT Intl. Search Report and Written Opinion dated Dec. 6, 2006, Appl. No. PCT-US2006-028260.
PCT Intl. Search Report and Written Opinion dated Dec. 4, 2006, Appl. No. PCT-US2006-028222.
PCT Intl. Search Report and Written Opinion dated Nov. 29, 2006, Appl. No. PCT-US 2006-031139.
PCT Intl. Search Report and Written Opinion dated Dec. 5, 2006, Appl. No. PCT-US 2006-028220.
PCT Intl. Search Report and Written Opinion dated Dec. 5, 2006, Appl. No. PCT-US 2006-027556.
Intl. Search Report dated Oct. 13, 2006, Appl. No. PCT-US 2006-020218.
Intl. Search Report dated Jul. 27, 2006, Appl. No. PCT-US 2005-032266.
U.S. Appl. No. 09/742,631, Office Action dated Aug. 18, 2003.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 09/747,525, Office Action dated Oct. 1, 2001.
U.S. Appl. No. 10/780,028, Office Action dated Oct. 4, 2006.
U.S. Appl. No. 10/780,028, Office Action dated Apr. 11, 2006.
U.S. Appl. No. 10/780,028, Office Action dated Oct. 18, 2005.
U.S. Appl. No. 10/938,434, Office Action dated Jul. 17, 2006.
U.S. Appl. No. 10/978,744, Office Action dated Jul. 19, 2006.
U.S. Appl. No. 10/938,434, Final Office Action dated Nov. 20, 2006.
U.S. Appl. No. 10/978,744, Final Office Action dated Nov. 13, 2006.
Intl. Search Report and Written Opinion dated Mar. 13, 2007, Appl. No. PCT/US2006/042787.
Intl. Search Report and Written Opinion dated Mar. 21, 2007, Appl. No. PCT/US2006/046057.
U.S. Appl. No. 11/123,372, Office Action dated Feb. 27, 2007.
U.S. Appl. No. 11/124,313, Office Action dated Feb. 28, 2007.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.
Office Action in U.S. Appl. No. 10/978,646 dated May 4, 2007.
International Search Report in PCT/US2007/020891 dated Mar. 3, 2008.
International Preliminary Report on Patentability and Written Opinion in PCT/US2007/020891 dated Apr. 9, 2009.

* cited by examiner

CANDLE AND WICK HOLDER THEREFOR

RELATED APPLICATIONS

This application is a continuation-in-part of U.S. patent application Ser. No. 10/780,028, filed Feb. 17, 2004 now U.S. Pat. No. 7,247,017, which is a continuation-in-part of U.S. patent application Ser. No. 09/747,525, filed Dec. 20, 2000, now U.S. Pat. No. 6,802,707. This application is also a continuation-in-part of U.S. patent application Ser. No. 10/978,744, filed Nov. 1, 2004 now U.S. Pat. No. 7,229,280, which is a continuation-in-part of U.S. patent application Ser. No. 10/938,434, filed Sep. 10, 2004 now U.S. Pat. No. 7,524,187. Each of these patent applications is incorporated by reference herein in its entirety.

FIELD OF THE INVENTION

The present invention relates to the field of candle illumination. In particular, the present invention relates to a melting plate candle that includes a melting plate designed to efficiently burn fuel.

BACKGROUND

Wax candles come in many varieties, such as tapers, pillar candles, container candles, and votive candles. Usually, such candles leave an amount of unconsumed wax at the end of the useful life thereof.

Some have attempted to minimize the amount of wax fuel left unused at the end of the candle's life. For example, one votive candle has a cup with a conically tapered bottom wall draining toward a central recess that causes melted wax to flow toward a central wick to provide complete consumption thereof. A cylindrical tube with apertures through the side wall extends upwardly from the recess and surrounds and supports the wick until the wax has been completely consumed. In another example, a wax burner in a flat-bottomed container includes a wick disposed in a hollow metal vertical tube with upper and lower radial heat fins. Holes through the tube side wall allow complete consumption of wax in the container.

In container candles, however, it was observed that sudden flare-ups, or "flash-over," sometimes occurred when the wax level became very low. Some have tried to prevent flash-over by causing the container candle to self-extinguish before all the wax has been consumed. For example, one container candle includes an anti-flash sustainer having an upwardly extending neck that holds a wick and a flat or concave base. The lower end of the neck is sealed so that the flame will automatically extinguish after the melted wax drops below the top of the neck. The sustainer may be mounted upon an upwardly extending pedestal on the container floor to further increase the amount of unconsumed fuel in the bottom of the container. In another container candle, a conventional wick holder is located within a raised disk-shaped locating recess in the bottom wall of the container. A raised peripheral lip around the locating recess prevents wax from flowing to the wick after the wax has dropped below the level of the lip, thereby leaving unconsumed fuel in the bottom of the container surrounding the raised locating recess. Unfortunately, such designs directed at minimizing flashover events sacrifice efficient fuel consumption by leaving the unconsumed wax at the end of the candle's life.

SUMMARY OF THE INVENTION

In one embodiment, the candle includes (a) a plate having a first surface; (b) a wick holder assembly having a wick and a second surface that is complementary to the first surface, wherein the wick has a top region and a bottom region; (c) fuel; and (d) a capillary space formed between the first surface and the second surface, wherein the capillary space has an inlet side and an outlet side and the outlet side is at an edge of the second surface; wherein the inlet side of the capillary space is proximate to the fuel and the outlet side of the capillary space is proximate to the bottom region of the wick.

In another embodiment, the present invention relates to a wick holder assembly for a candle on a plate that includes a capillary recess or a capillary pedestal, including: (a) a capillary base having a top surface and a bottom surface; (b) a tube extending upward from the top surface of the capillary base; (c) a bottom reservoir defined within the capillary base for holding fuel; (d) a wick disposed through the tube in fluid communication with the top surface of the capillary base; (e) an aperture through the bottom surface; wherein the fuel included in the bottom reservoir travels via the aperture to a capillary space formed between the capillary base and the capillary recess or pedestal through which the fuel can flow to the top surface of the capillary base.

In yet another embodiment of the present invention, the candle includes: (a) a plate having a first surface, wherein the plate comprises a heat-conducting material and an insulating base portion; (b) a wick holder assembly having a wick and a capillary base that includes at least part of a second surface that is complementary to the first surface, wherein the wick has a top region and a bottom region and the capillary base is configured to include a bottom reservoir and a top reservoir; (c) meltable fuel; and (d) a capillary space formed between the first surface and the second surface, wherein the capillary space has an inlet side and an outlet side and the outlet side is at an edge of the second surface; wherein the inlet side of the capillary space is proximate to the meltable fuel and the outlet side of the capillary space is proximate to the top reservoir, and the bottom region of the wick contacts the top reservoir.

DETAILED DESCRIPTION

Figure 1:
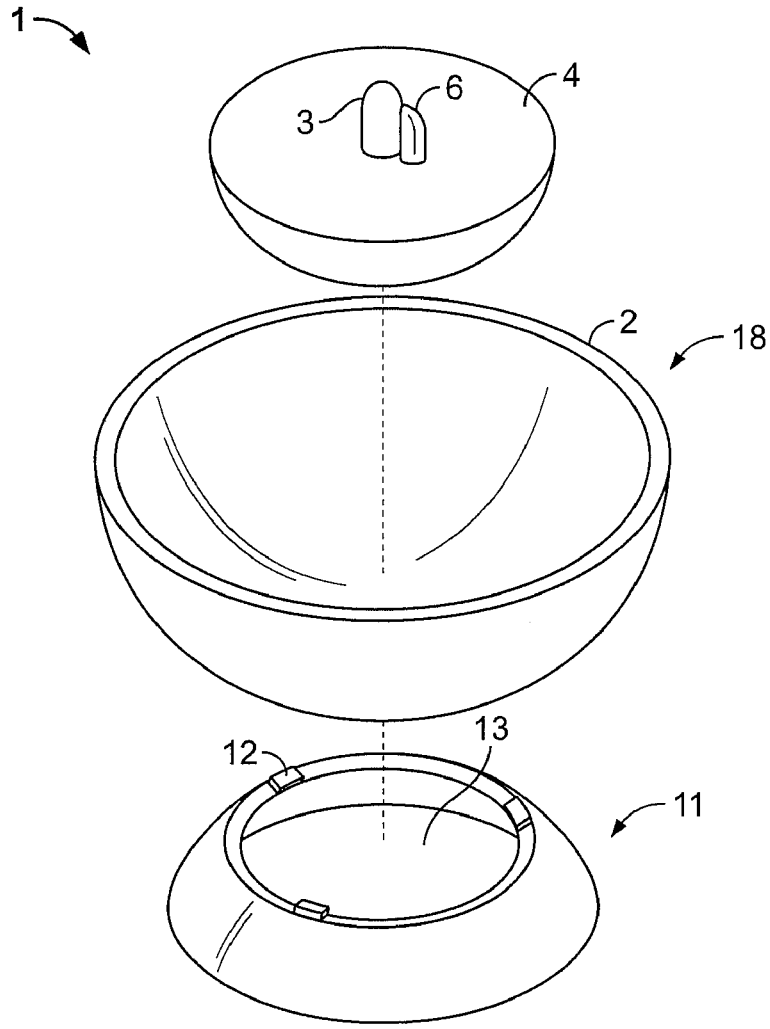
FIG. 1 is an exploded isometric view of a melting plate candle.

In one embodiment of a melting plate candle of the present disclosure, a charge of meltable fuel melts in the vicinity of a flame disposed on a wick and forms a pool on the melting plate. The end of the wick may be held at a relatively constant height, so the flame does not move significantly downward from its initial position. As a result, a consistent flame may be maintained by the melting plate candle at a substantially defined, invariant position relative to structural features of the melting plate candle.

Meltable fuels contemplated include fuels such as paraffin, beeswax, montan wax, carnauba wax, microcrystalline wax, polyvinyl acetate, fatty alcohols, fatty acids, fatty esters, and gels incorporating such fuels. The charges of the meltable fuel may be shaped into forms such as pucks, donuts, chips, slivers, balls, pellets, shavings, particulates, cubes, discs, three dimensional shapes, and wafers, or in any other shape suitable to its function as candle fuel. The fuel used in the context of the present invention may also include volatile or substantially volatile materials such as, without limitation, fragrances, air fresheners, deodorizers, odor eliminators, odor counteractants, insecticides, insect repellants, miticides, herbals, medicinal substances, disinfectants, sanitizers, mood enhancers, aroma therapy compositions, and the like. The charges of the meltable fuel may be colored for the purpose of decoration and/or identification. The shape of the charge of meltable fuel may be designed to fit any given configuration of melting plate and/or wick holder assembly, including without limitation intended, those disclosed herein. For example, the sides of a charge may be shaped complementarily in order to fit the interface between the melting plate and the wick holder assembly using one or more pieces thereof. Preferably, the charge of meltable fuel is a single piece that is molded or cut to fit at or near the wick holder assembly. As a general rule, the fuel used preferably has a melting temperature above ambient, but below the temperature of the fuel's combustion such as that of the flame itself.

In one embodiment, the melting plate candle includes a melting plate that may support one or more charges of a meltable solid and/or gel fuel and a wick holder assembly with a wick holder that is in contact with a wick. Alternatively, or in addition, the melting plate may be filled with a liquid fuel. The wick holder assembly may further have heat transfer elements, such as heat fins, to improve heat transfer from a flame on the wick to both the meltable fuel and the melting plate with which the fuel is in contact, thereby heating the fuel over a relatively large surface. This, in turn, provides for more rapid melting of the meltable fuel and a more uniformly heated pool of melted fuel, which further provides efficient evaporation of the volatile materials that may be present in the fuel as well as an improved rate of fuel consumption.

The melting plate and/or wick holder assembly preferably includes a heat-conductive material, such as, for example, a metal, although any material is contemplated for use. Preferably, the heat conductive material is substantially nonflammable. In one embodiment, the melting plate is made of polished aluminum due to its relatively high heat conductivity, low combustibility, light weight, and aesthetically pleasing appearance. Further, the melting plate may include a non-heat conductive body with a heat conductive laminate applied thereto. Preferred heat conductive laminates include, without limitation, a thin layer of metal, such as foil prepared from any meltable metal, including, for example, aluminum.

The melting plate and wick holder assembly therefore provide improved heat transfer from the flame on the wick to the meltable fuel. The melting plate may also be shaped so as to direct the melted or liquefied fuel to a point where fluid communication is established with the wick, such as, a capillary lobe, channel, surface, or a depression of the wick holder assembly or with which the wick holder assembly is in contact. In one embodiment, the melting plate is bowl shaped, but may be any other functionally appropriate shape including, for example, a funnel, a plate with an inclined inner surface, a plate with fluid channels therein, a plate with capillary grooves, and the like, having one or more points where a liquid can pool. The melting plate may also be shaped to control the shape and depth of the pool of fuel, which is burned at the flame that is disposed at the wick.

In another embodiment, the candle includes preferably a plate, also called a melting plate or a heat-conductive plate herein, having a first surface that is at least a part of a capillary recess or a capillary pedestal included on the top of the plate. The first surface is fashioned particularly with respect to a second surface that is included in a wick holder assembly. The wick holder assembly is in contact with the plate and preferably includes a wick holder having a wick that is supported by a capillary base. The capillary base preferably includes at least a part of the second surface by which it is in contact with the plate, an internal bottom reservoir, and an external upper reservoir. The wick itself has a top region and a bottom region. The candle also includes a preferably meltable fuel that is situated within or adjacent to the wick holder assembly; more preferably the meltable fuel is located in the bottom reservoir of the capillary base. A capillary space is preferably formed between the first surface and the second surface, wherein the capillary space has an inlet side and an outlet side and the outlet side is preferably at an edge of the second surface. The inlet side of the capillary space is preferably proximate to the fuel and the outlet side of the capillary space is preferably proximate to the bottom region of the wick. Accordingly, the wick is in fluid communication with the fuel of the bottom reservoir that, upon melting, enters the inlet of the capillary space, exits the outlet thereof onto the upper reservoir, and from there preferably enters the bottom region of the wick. The plate itself optionally includes a retaining ridge that preferably serves to course the melted fuel toward the inlet side of the capillary space, or to retard the flow of the melted fuel away therefrom.

The capillary base preferably fits into a corresponding structure on the plate. In the case where the capillary base has a convex bottom, the plate preferably includes a capillary recess into which the capillary base fits. Alternatively, in the case where the capillary base has a concave or scooped in bottom, the plate preferably includes a capillary pedestal onto which the capillary base fits. Either way, the first surface included on the plate at and/or in the capillary recess or capillary pedestal is complementary to the second surface included on the capillary base.

Preferably, the first surface and the second surface releasably lock together. In this embodiment, each of the first and second surfaces includes interlocking features therefor. For example, in a preferred embodiment, the first surface includes a first snap-on detent member that engages a second snap-on detent member included on the second surface. In another preferred embodiment, the first and second surfaces have complementary spiral protrusions such that the second surface screws into or onto the first surface, as appropriate.

The plate preferably includes an insulating space disposed between the heat-conducting material and a support base. The insulating space can be a void or it can include heat-insulating material, such as, without limitation, ceramic, Styrofoam, cellulose, and the like. By this inclusion of insulating space, the melting plate can more readily be transported and placed on any surface without concern that the heat of the candle will mar the surface.

The wick holder assembly preferably includes a tube extending from a capillary base. The tube serves to hold a wick in place such that a top region of the wick extends up from the tube and the bottom region of the wick extends down toward the upper surface of the capillary base. The upper surface of the capillary base preferably has a flat or concave surface so that melted or otherwise liquefied fuel that is deposited there is able to flow into the bottom region of the wick. The fuel is thus able to flow to the top of the wick and supply a flame disposed at the top region of the wick when the wick is ignited. This upper surface of the capillary base is also referred to herein as the upper reservoir, which is consonant with the function it serves in preferably being in contact with the bottom region of the wick and so providing the wick with liquefied fuel. As further noted elsewhere, the capillary base can have a convex or a concave bottom surface, or combination thereof, depending on whether the capillary base is intended to fit (a) into a capillary recess (appropriate, then, for a convex bottom surface) or (b) onto a capillary pedestal (appropriate, then, for a concave bottom surface) or (c) into a capillary recess where the capillary base includes a top structure that extends laterally beyond the horizontal dimensions of the capillary recess. With respect to scenario (c), the contents stored within the cavity defined by the top structure (the bottom reservoir, that is) would first come into direct contact with the top surface of the plate outside of the capillary recess prior to entry into the inlet of the capillary space formed between the capillary base and the capillary recess. In contrast, scenario (a) would require that the contents of the bottom reservoir would contact the bottom of the capillary recess where the capillary space inlet would be found, and thus travel by capillary action to the upper reservoir via a wall of the capillary recess that extends up from the top surface of the plate. Accordingly, the liquefied fuel is thereby delivered to the upper reservoir where it then comes into contact with the bottom region of the wick.

The wick holder assembly preferably further includes a bottom reservoir for holding fuel. The bottom reservoir is defined by a cavity within the capillary base, which can have a convex bottom or a concave bottom. Alternatively, the bottom reservoir is an open concavity below the upper surface of the capillary base, which is further described below.

The open concavity preferably has a peg extending centrally that connects at the upper underside of the capillary base. More preferably, the peg includes a central longitudinal bore that opens at its bottom that is seated in the capillary recess and extends up to the top surface of the capillary base that defines the upper reservoir. Fuel stored within the open concavity, upon melting or otherwise liquefying, will first come into contact with the top surface of the plate, enter the inlet of the capillary surface and head down to the outlet thereof at the edge of the peg. From that point, the liquid fuel heads up the bore of the peg by capillary action and is then deposited on or at the upper reservoir located on the top surface of the capillary base.

The capillary base having a convex bottom includes preferably an internal void that further includes, optionally, a first aperture toward or at its bottom and/or a second aperture toward or at its top. The first aperture serves, for example, to place the contents of the bottom reservoir in fluid communication with the bottom of the capillary recess when the capillary base is seated therein. The second aperture serves, for example, to provide a direct path for the wick to extend therethrough and be in fluid communication with the contents of the bottom reservoir. Where only the first aperture is in place in this embodiment, liquid fuel will first contact the bottom of the capillary recess, there enter the inlet of the capillary space and travel up to the outlet thereof, which is located at the edge of the top surface, i.e., the upper reservoir, of the capillary. Accordingly, for this embodiment, the capillary recess includes a wall that extends up from the top surface of the plate in order to define an outlet of the capillary space formed between the capillary base and the capillary recess. The outlet so defined is situated such that the liquid fuel collects on or at the upper reservoir, i.e., the upper surface of the capillary base.

Where the capillary base having a convex bottom includes the second aperture and not the first aperture, then the fuel will travel to the upper region of the wick by way of the lower region of the wick directly from the bottom reservoir. Any fuel in the bottom reservoir that is below the level of the bottom of the wick will not be used. If, however, the first aperture is also included, then liquid fuel in the bottom reservoir has two paths to the upper region of the wick: first, via direct entry into the wick where it extends into the bottom reservoir; and second, via indirect entry into the wick, as set forth in the immediately preceding paragraph.

The capillary base having a concave bottom is preferably designed to seat onto a capillary pedestal. The capillary base of this embodiment preferably includes at least one aperture at the bottom of the capillary base, thus placing the bottom reservoir in fluid communication with the top and/or side of the capillary pedestal, or the top surface of the plate immediately adjacent to the capillary pedestal, or any two or all of the recited locations. Surrounding the capillary pedestal is preferably a wall that arises up from the top surface of the plate. The wall has a shape and dimension such that its inner surface forms part of the aforementioned first surface of the plate, and is situated so that the first surface is disposed relative to the second surface included on the capillary base to form the capillary space. The inlet of the capillary space is located at the bottom edge of the concave bottom of the capillary base where that portion of the second surface included on the capillary base forms a capillary space with the first surface included on the plate and wall thereof. From that point, the liquid fuel travels up toward the upper surface of the capillary base in similar fashion as described above with respect to the indirect entry of the liquid fuel in the capillary base having a convex bottom, as set forth above.

The wick holder assembly of the present invention preferably also includes a snap fit detent on the bottom surface of the capillary base. Preferably, the wick holder assembly further includes a heat fin. The heat fin transmits heat from a flame disposed on the top portion of the wick to, preferably, the plate, or, more preferably, fuel stored in the bottom reservoir, or, yet more preferably, to a charge of fuel that is located in the vicinity of the wick holder assembly. The heat fin preferably has a single surface; more preferably, the heat fin has multiple surfaces, such as, for example, two surfaces, three surfaces, four surfaces, or more. Most preferably, the heat fin includes two surfaces. The surface or surfaces of the heat fin preferably faces the upper or top region of the wick.

The wick holder assembly preferably further comprises an aliquot of additional fuel that is proximate to the top region of the wick. Upon igniting the top region of the wick, the first fuel to become available is the aliquot of additional fuel, which is also referred to commonly as a "bump". The bump preferably provides sufficient fuel so that a sufficient amount of heat is generated and transmitted to the meltable fuel of the bottom reservoir and/or the meltable fuel adjacent to the wick holder assembly such that a sufficient amount of the meltable fuel melts, arrives at the upper reservoir, and contacts the bottom region of the wick in time to provide fuel to the flame before the bump fuel is exhausted. The aliquot of additional fuel can be a meltable solid or a gel or a liquid prior to igniting the wick; preferably, the additional fuel is a meltable solid.

Figure 2:
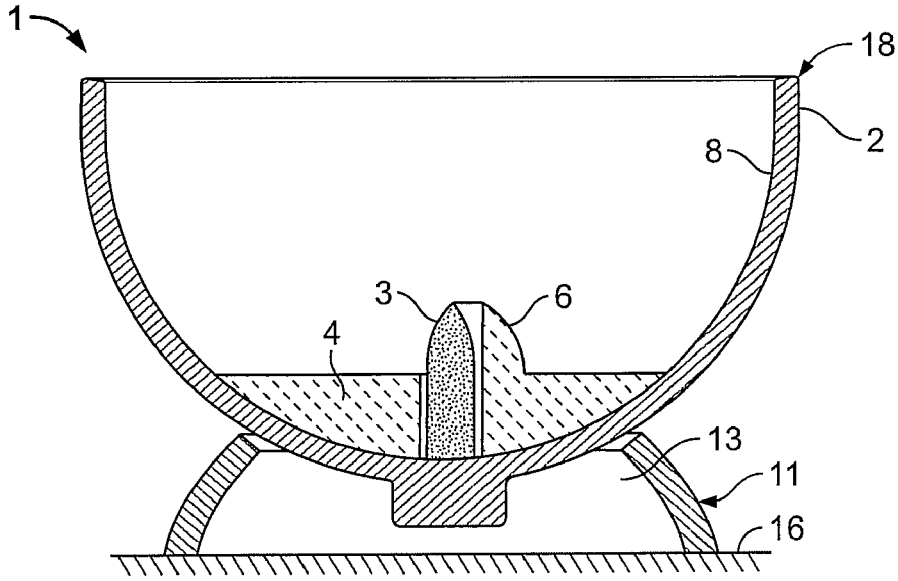
FIG. 2 is a cross-sectional view of the melting plate candle of FIG. 1 in an assembled condition.

Turning now to the figures, FIGS. 1 and 2 illustrate one form of a broad concept of a melting plate candle 1. In this general form, a heat conductive melting plate 2 conducts heat from a flame (not shown) located on a wick 3 to a meltable fuel charge 4 resting upon the surface of the melting plate. Further, the wick 3 has a relatively large diameter compared to a more typical fibrous wick that commonly has a smaller diameter. The wick 3 is disposed in close proximity to the meltable fuel charge 4 but not in direct contact with the unmelted fuel. Preferably the wick is held by a wick holder assembly or clip (not shown). The melting plate 2 is heated directly or indirectly by the flame on the wick 3 by radiation, as a result of the exposure of the inner surface 8 of the melting plate to the heat from the flame. The bowl-shaped melting plate 2 has a raised outer shoulder 18 to provide containment for a pool of fuel (not shown) melted by the flame on the wick 3. In other embodiments, the melting plate 2 may have the shape of a tray, a concave plate, or any other configuration that is capable of holding the pool of fuel, and may be shaped so as to funnel and/or channel the liquefied fuel to the wick 3. Further, the melting plate 2 need not be limited to plate structures per se, but may include other non-plate shapes that can perform the same functions described herein. The melting plate 2 may constitute a container in itself, as presented herein, or may be combined with a separate container (not shown).

The melting plate 2 rests upon a preferably non-conductive base 11, but alternatively may use legs (not shown) of non-conductive and/or insulating material. The purpose of the non-conductive material is to insulate a surface 16 from heat from the melting plate, such as, for example, a table or other heat-sensitive surface upon which the melting plate candle 1 may be placed. In the embodiment illustrated in FIG. 1, the base 11 has contact points 12 to minimize contact between the base and the melting plate 2 and to create an insulating gap 13 between the melting plate and any surface upon which the melting plate may be placed. The non-conductive base 11 may be constructed of any non-conductive material including, for example, wood, plastic, a non-conductive metal, a polymer, glass, and other materials known to those skilled in the art.

The melting plate 2, or any embodiment thereof, is preferably made from any suitable material, the suitability of which is a function of being substantially heat conductive yet also being substantially nonflammable. More preferably, the suitable material is nonflammable. Representative suitable heat conductive materials include, without limitation, brass, aluminum, steel, copper, stainless steel, silver, tin, bronze, zinc, iron, clad materials, heat conductive polymers, ceramics, glass, and/or any other suitable heat conductive material, and combinations thereof. Further, the melting plate preferably includes a coating of a surface tension-modifying material applied thereto for purposes of preparing a self-cleaning and/or easily cleaned melting plate, as well as to facilitate flow of melted fuel to, for example, a capillary depression, channel, or other surface in contact with the wick. As an example of a suitable surface-tension-modifying material, a polytetrafluoroethylene coating may be applied to the melting plate surface to provide a coating that has a smooth wetting surface upon which molten wax will generally flow more easily as compared to an uncoated surface. Further, the coated surface facilitates removal of residual wax from the melting plate.

As shown in FIG. 2, the meltable fuel charge 4 is in direct contact with the surface of the melting plate 2 to facilitate melting of the fuel charge via heat transfer. In another embodiment, the melting plate 2 is preferably constructed with a non-conductive lower surface to insulate a surface 16 from heat from the flame. In this embodiment, the melting plate 2 may be partially or wholly constructed of a clad material, wherein the top surface of the plate includes a metallic clad material that is bonded to another material. Preferably, the material to which the clad material is bound is non-conductive and provides protection to a heat-sensitive surface on which the melting plate may be placed. Preferred combinations of materials for the melting plate include a conductive material coated on the external surface of an otherwise non-conductive material, a non-conductive material having an insert of a heat conductive material, or other suitable configurations to permit the melting plate to be easily handled, and/or placed on heat-sensitive surfaces.

A wick 3 contemplated for use in the context of the present invention is preferably a conventional consumable wicking material, such as, without limitation, cotton, cellulose, nylon, paper, or the like. By capillary action, liquid fuel transfers through the wick to the flame disposed thereon. Alternative preferred wicks 3 are substantially non-consumable, such as those composed of porous ceramics and/or porous metals, fiber glass, metal fiber, compressed sand, glass, metal, and/or ceramic microspheres, foamed and/or porous glass, and/or natural and/or man-made materials, such as pumice, perlite, gypsum, chalk, and the like. Further, composite wicks that include consumable and non-consumable wicking materials are usefully employed in the context of the present invention.

The wick 3 may be situated at any location on or near the melting plate, provided that at least some of the heat of a flame disposed on the wick is transferable to the stored fuel charge 4. The stored fuel charge is preferably located in contact with the melting plate; alternatively, the fuel charge can be included in a wick holder assembly (described further below), which, in one embodiment, is configured so that the heat of the flame is transferred thereto and the melted fuel optionally contacts the plate. The heat contained in the plate preferably serves to melt the meltable fuel and/or maintain the liquid quality of the fuel once melted until the melted fuel is transported to the flame and consumed. The heat transference is accomplished via radiation, convection, and/or conduction of the heat energy from the flame to the wick holder assembly and the plate. Accordingly, the wick 3 may be centrally located in the melting plate 2 or located off-center. A plurality of wicks 3 is also envisioned in another embodiment of the present invention.

In yet another embodiment, a starter bump 6 on the meltable fuel charge 4 is preferably provided in close proximity to the wick 3 to facilitate the lighting of the wick. The starter bump serves to provide a ready source of liquid fuel to the wick 3 when a match or other appropriate source of flame is employed to ignite the wick, which source of flame will melt the starter bump and thus create an initial pool of liquid fuel. In this embodiment, the starter bump 6 may be molded directly into the shape of the meltable fuel charge 4; alternatively, the starter bump 6 may be added after molding of the meltable fuel charge. The starter bump is also referred to herein as an aliquot of additional fuel, which, in another embodiment, serves to provide sufficient heat to melt a sufficient amount of the meltable fuel over a sufficient period of time such that the flow of melted fuel preferably reaches the flame before the additional fuel of the bump is fully consumed.

Figure 3:
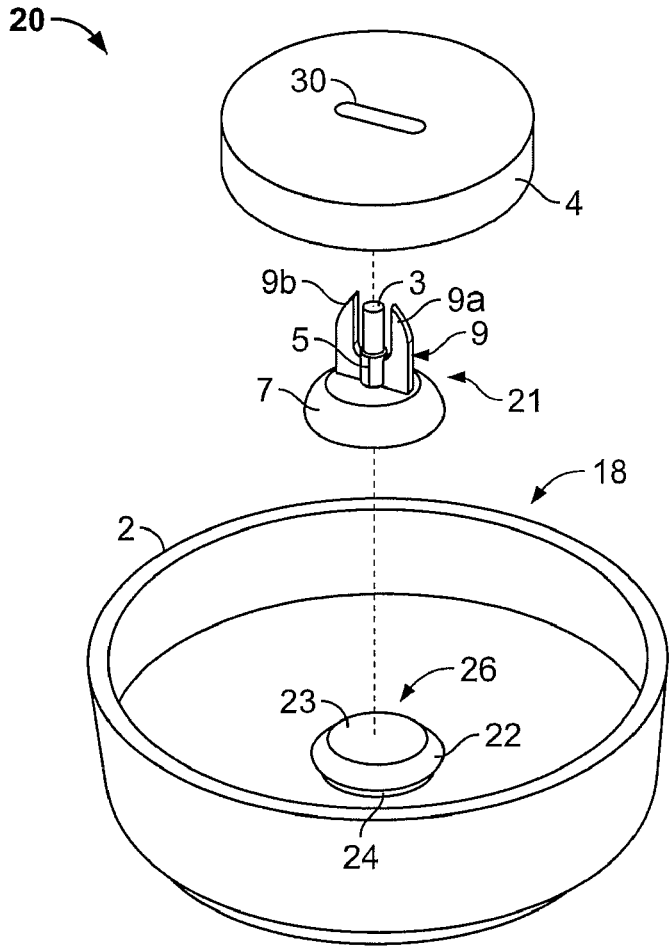
FIG. 3 is an exploded isometric view of a melting plate candle according to another embodiment.
Figure 4:
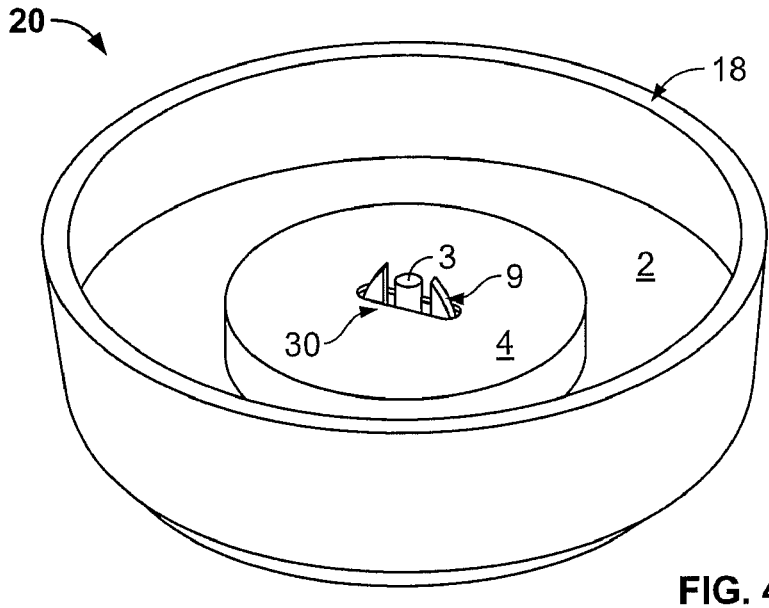
FIG. 4 is an isometric view of the melting plate candle of FIG. 3 in an assembled position.

In another embodiment of a melting plate candle 20 shown in FIGS. 3 and 4, the wick 3 is provided in conjunction with a wick holder assembly 21 that, preferably, cooperatively engages a complementarily shaped capillary lobe or pedestal 26 on the melting plate 2. The melting plate 2 is preferably bowl-shaped with a raised shoulder 18 to contain a pool of melted wax or other fuel (not shown) and a centrally disposed capillary pedestal 26. The wick holder assembly 21 is preferably shaped to fit closely over the capillary pedestal 26 and to releasably engage an undercut 24 therein so as to be releasably secured thereon. The undercut 24 is intended to secure the wick holder assembly 21 to the melting plate 2 to minimize the possibility of the wick holder assembly being accidentally unseated from the capillary pedestal 26.

The wick holder assembly 21 preferably includes a wick holder 5, the wick 3, and a heat fin 9. The heat fin 9 facilitates heat transfer from the flame on the wick to a meltable fuel charge 4. The meltable fuel charge 4 preferably has a cutout portion 30 through which the wick holder assembly 21 may pass. Alternatively, the meltable fuel charge 4 is preferably placed adjacent the wick holder assembly 21 on one side thereof (not shown). In yet another alternative, the meltable fuel charge 4 is preferably provided in multiple pieces of meltable fuel that can be placed about the wick holder assembly 21. More preferably, the multiple pieces of the meltable fuel are appropriately shaped (not shown) to both fit together when placed about the wick holder assembly 21. Any configuration of the meltable fuel charge 4 is suitable so long as it places the wick 3 and the heat fin 9 each in close proximity to a top surface of the meltable fuel charge, and/or includes conductive material for transferring the flame's heat to the fuel charge; or otherwise facilitates heat transfer to the meltable fuel charge, irrespective of the number of pieces of which the fuel charge is composed. Here, the meltable fuel charge 4 is shown as a wax puck having a void slot at its center; other shapes and sizes are contemplated as described herein.

FIG. 4 shows the embodiment of FIG. 3 in one preferred operational configuration showing the relationship of the elements in position for lighting of the wick 3. The melting plate 2 is shown with the wick holder assembly 21 positioned on the capillary pedestal 26 (not visible). Further, the meltable fuel charge 4 is disposed around the wick holder assembly 21, with the heat fin 9 and the wick 3 extending through the cutout portion 30 of the meltable fuel charge. The wick holder assembly 21 may be secured in the cutout portion 30 with a small amount of wax backfill after assembly.

Operationally, the melted wax flows to the bottom surface of the heat-conductive melting plate, where it ultimately enters the inlet (not shown, but is co-extensive with the undercut 24) to the capillary space (also not shown) that is formed between the concave underside of the wick holder assembly 21 (i.e., the underside of the capillary base 7) and the upper surfaces 22, 23 of the capillary pedestal 26 upon seating the wick holder assembly 21 thereon. The melted wax then travels via capillary action to the angled upper surface 22 and then to the upper, substantially horizontal surface 23 of the capillary pedestal. The wick 3 has an upper region (visible in the drawing of the wick holder assembly 21) and a lower region (obscured by the tube 5 that is disposed between the heat fins 9*a*, 9*b* and upon the top surface of the capillary base 7. The lower region of the wick 3 preferably contacts the substantially horizontal surface 23 of the capillary pedestal 26. Accordingly, the melted fuel of the fuel charge enters the wick 3 via its lower region, and is then consumed by the flame (not shown) disposed at the upper region of the wick 3.

Figure 5:
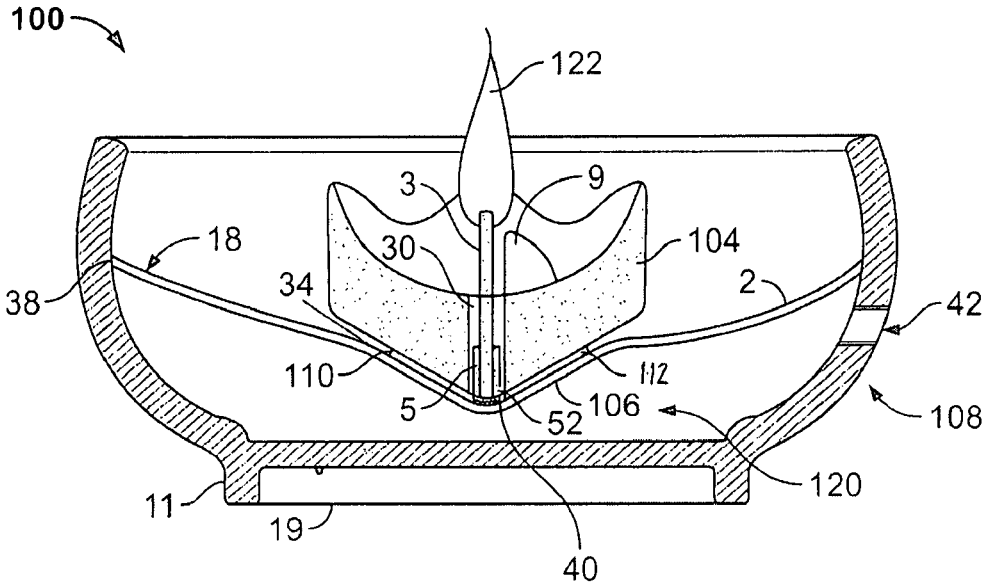
FIG. 5 is a cross-sectional view of a melting plate candle having a capillary depression according to another embodiment.
Figure 6:
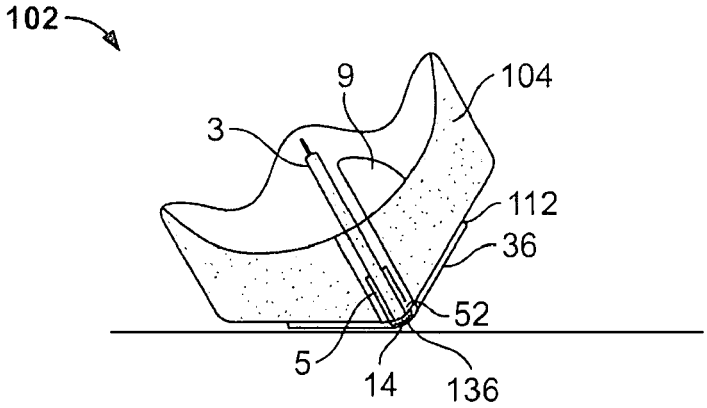
FIG. 6 is a cross-sectional view of a fuel element shown in FIG. 5.

In a further embodiment of a melting plate candle 100 and a wick holder assembly 102 shown in FIGS. 5 and 6, the wick holder assembly has a convex capillary base 36 that is disposed within a centrally located capillary depression, such as a capillary recess 106 in the heat conductive melting plate 2. In one embodiment, the convex capillary base 36 has a sloped bottom wall, such as a conical wall, having a bottom surface that forms an inverted peak that fits into the capillary recess 106 and a top surface that forms a depression. One or more snap-fit detents, such as ribs 110, may be disposed on the surface of the melting plate 2. In a preferred embodiment, the ribs 110 are disposed in or around an edge of the capillary recess 106 to secure the wick holder assembly 102 to the melting plate by hooking or snapping onto an end portion 112 of the capillary base 36. The melting plate 2 is preferably disposed within a non-heat conductive, or insulating, support body 108 for placement on a surface (not shown). A preferred form of this embodiment includes a sealing interface 38 between the melting plate 2 and the support body 108, such as adhesive and/or a tongue and groove fit, thereby preventing fluid flow therebetween. An insulating space 120 between the melting plate 2 and the support body 108 helps to protect the supporting surface 19 from excess heat when a flame 122 is disposed on the wick 3. The insulating space 120 also reduces heat loss from the melting plate to the support body and supporting surface. A meltable fuel charge 104 is preferably adjacent or included within the capillary base 36, such that the wick 3 and the heat fin 9 transfer heat thereto. The wick 3 is held within a wick holder 5; the wick 3 and the heat fin 9 both extend from the convex capillary base 36 upon, within, or adjacent to which the meltable fuel charge 104 resides. The meltable fuel charge 104 may be integrally molded around the wick 3, the wick holder 5, and the heat fin 9 on top of the convex capillary base 36 so as to make an integral unit, or the meltable fuel charge may be integrated with the wick holder assembly 102, for example included in a cavity included in the capillary base 36. Alternatively, the meltable fuel charge can be constructed as described above with respect to FIGS. 3 and 4; i.e., a single piece with a void slot 30 disposed within it or extending from one side, or multiple pieces that fit on the melting plate 2 at and about the wick holder assembly 102. Further, one or more apertures 42 may be provided through the side of the support body 108 into the insulating space 120 to provide ventilation and to help regulate the temperature therein.

A bottom portion of the wick 3 preferably rests on a top surface of the convex capillary base 36 or may protrude through an aperture 136 in the convex capillary base to allow fluid communication with a bottom surface thereof. When the wick holder assembly 102 is placed within the capillary recess 106 of the melting plate candle 100, a capillary space 40 is formed between the bottom surface of the convex capillary base 36 and the top surface 34 of the capillary recess 106 through which liquid fuel (not shown) may be drawn by capillary action from the melting plate 2 to the bottom portion of the wick 3 to effectively consume substantially all of the liquid fuel. Alternatively, or in addition, an aperture 52 in the side of the wick holder 5 may be disposed adjacent the top surface of the convex capillary base 36 to allow liquid fuel in the depression on the top surface of the convex capillary base to supply the wick 3.

Figure 7:
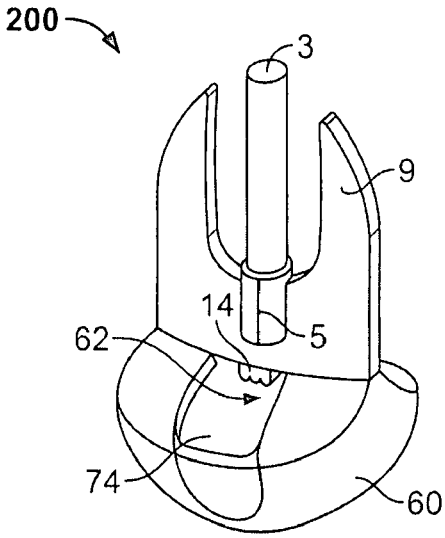
FIG. 7 is an isometric view of a wick holder assembly for a melting plate candle having a capillary depression according to yet another embodiment.
Figure 8:
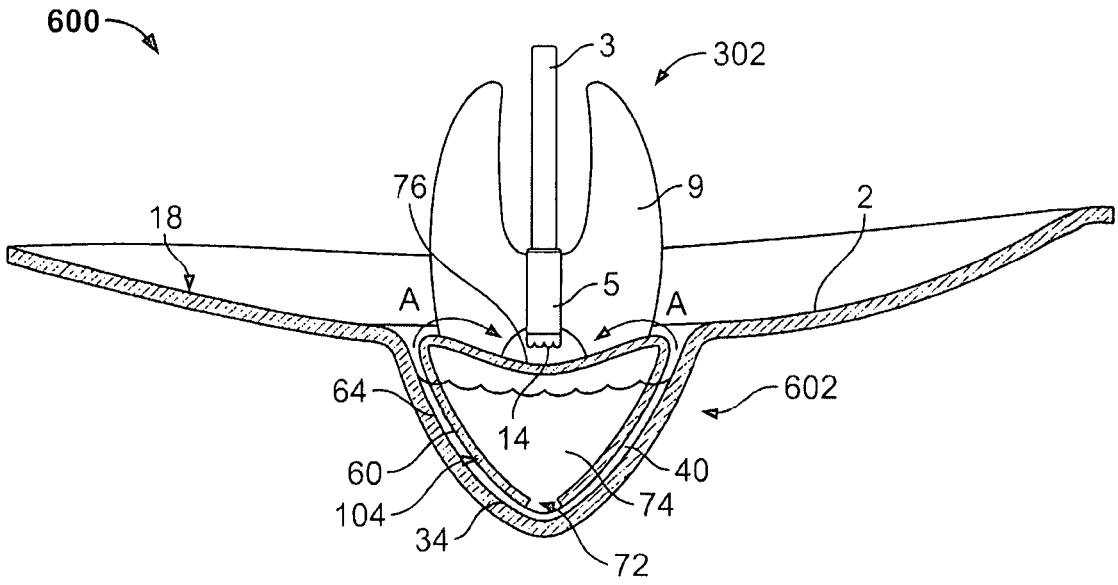
FIG. 8 is a cross-sectional view of a melting plate candle having a capillary depression and a wick holder assembly according to a further embodiment.
Figure 9:
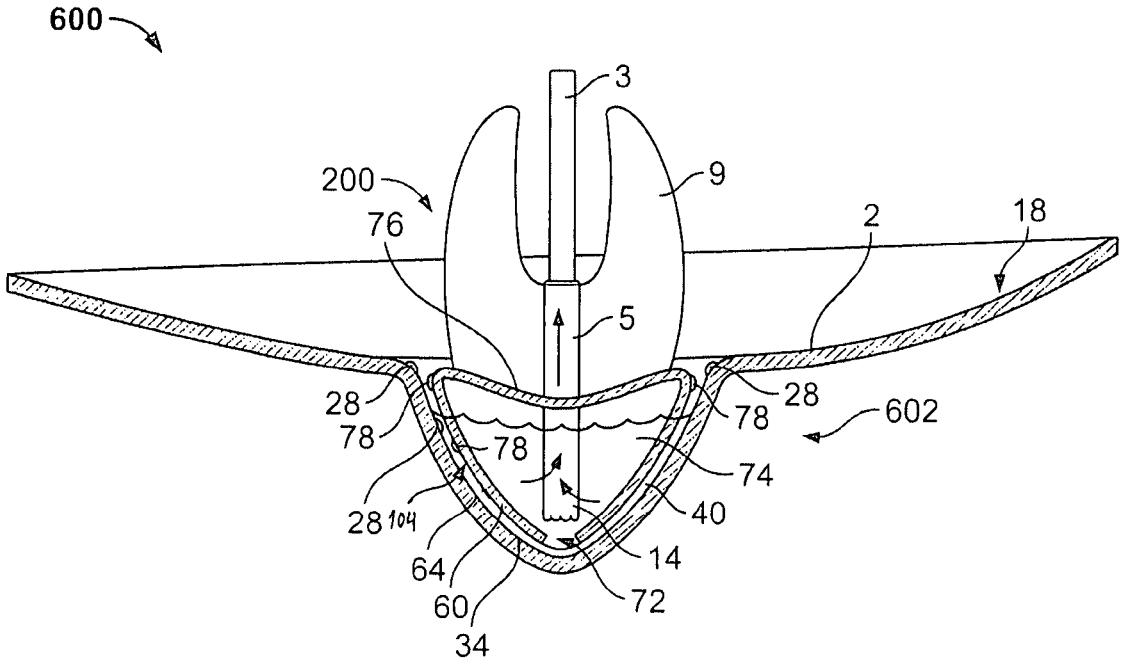
FIG. 9 is a cross-sectional view of a melting plate having a capillary depression and a wick holder assembly according to an even further embodiment.
Figure 10A:
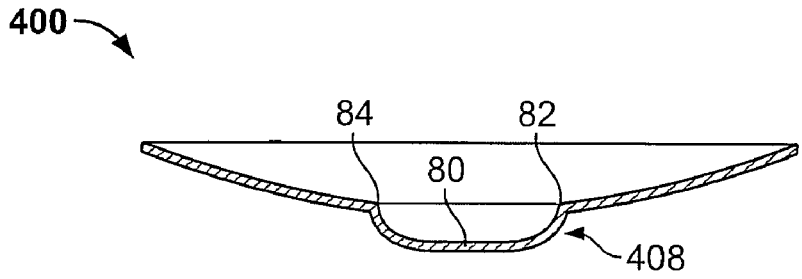
FIGS. 10A-10D are cross-sectional views of melting plates having capillary depressions of different configurations.
Figure 10B:
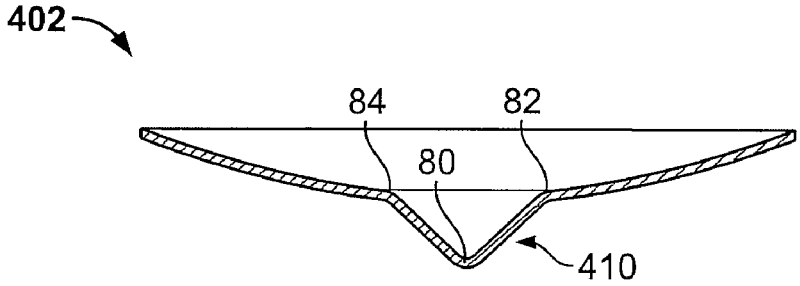
Figure 10C:
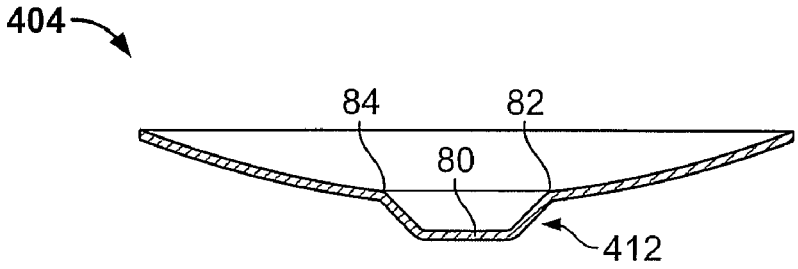
Figure 10D:
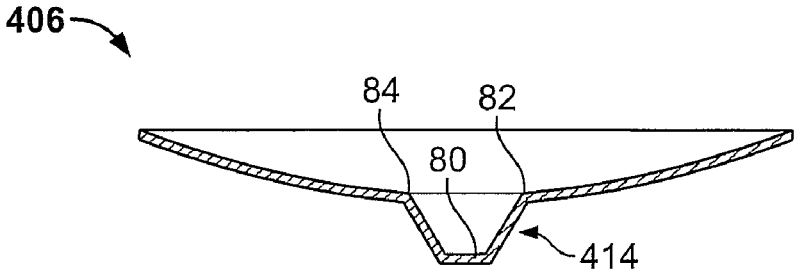

FIG. 7 depicts a further embodiment of a wick holder assembly 200 adapted for use with a melting plate candle 600 having a capillary recess 602, as depicted in FIGS. 8 and 9. A wick holder 5, which holds a wick 3 and, preferably, a heat fin 9, is disposed atop a hollow convex capillary base 60. An aperture 62 in the top of the hollow convex capillary base 60 allows liquid fuel, such as oil or melted wax, to fill an internal fuel reservoir 74 (also called herein a lower reservoir) inside the hollow convex capillary base 60. The internal fuel reservoir 74 of the wick holder assembly 200 may be initially filled with a second meltable fuel charge (not shown). A bottom portion 14 of the wick 3 may protrude through an aperture (not shown) in a bottom surface of the wick holder 5 and/or a top surface of the hollow convex capillary base 60 into the internal fuel reservoir 74 to place the wick in fluid communication with the internal fuel reservoir.

FIG. 8 shows a further embodiment of a melting plate candle 600 having a wick holder assembly 302 (similar to that of FIG. 7) and a melting plate 2. The wick holder assembly 302 is preferably disposed within a capillary recess 602 of the melting plate 2. Prior to use, the underside of the convex capillary base 60 preferably contains meltable, but unmelted fuel. Upon use, i.e., upon igniting the wick 3, heat is transferred to the meltable fuel 104 in the internal fuel reservoir 74 via, in part, the heat fins 9, of which there is one or more (two shown in FIG. 8), thus melting the fuel. Melted fuel flows by gravity through one or more apertures 72 (one shown) that is/are located at or toward the lowest point in the convex capillary base 60. Liquefied fuel then moves upward via capillary action through the capillary space 40 that exists between the surface 64 of the capillary recess 602 and the convex capillary base 60. The wick holder 5 is preferably attached to the heat fin 9 and is disposed above a top surface 76 of the hollow convex capillary base 60 such that a bottom portion 14 of the wick 3 extending out of the bottom end of the wick holder 5 is disposed at the top surface 76 of the convex capillary base 60 where the wick is in fluid communication with the liquefied fuel that emerges from the capillary space 40 at point A. Accordingly, a steady supply of fuel is maintained to the wick 3 by being drawn by capillary forces out of the lower reservoir 74, up through the capillary space 40 in a direction A, and over the top surface 76 of the convex capillary base 60 to the bottom portion of the wick 3 until all of the fuel in the reservoir and capillary recess is consumed. The top surface 76 of the convex capillary base 60 is also referred to herein as the upper reservoir, which is preferably flat or concave in shape.

FIG. 9 shows a variation of the wick holder assembly 302 of FIG. 8 (referred to as wick holder assembly 200 in FIG. 9), except that the bottom portion 14 of the wick 3 passes through an aperture (not shown) in the top surface 76 of the convex capillary base 60 into the internal fuel reservoir 74. In this example, liquid fuel reaches the wick 3 via the capillary space 40 as well as via the bottom portion 14 of the wick 3, which preferably contacts the lowest level of fuel in the reservoir 74. Protrusions, such as ribs 28 within or at the upper edge of the capillary recess 602, are preferably used to secure the wick holder assembly 200 by interacting with one or more raised protrusions 78 on the convex capillary base 60. In one embodiment, the ribs 28 may have a snap-fit with the protrusions 78, and in another embodiment, the ribs 28 may form a spiral pattern on the surface 64 of the capillary recess 602, such that the protrusions 78 may be screwed into threads (not shown) formed between the ribs to secure the convex capillary base 60 within the capillary recess 602. Other preferred designs for securing the wick holder assembly 200 to the plate 2 include any lock and key mechanism, as long as continuity of the capillary space 40 is maintained so that the fuel flow is maintained.

Although a recessed shape is illustrated in FIGS. 8 and 9 for the place where the wick holder assembly 102, 200 and 302 is seated, the bottom of the wick holder assembly and the upper surface of the melting plate 2 where the wick holder assembly is seated may each have any shape that is at least partially complementary to one another. A pair of shapes is sufficient if the plate-base structure 106, 602 in the melting plate 2 allows proper fit with the wick holder assembly 102, 200, or 302 to form one or more capillary spaces 40 that allows adequate fuel supply to the wick 3 to feed a flame disposed thereon. In some embodiments, instead of a recessed plate-based structure 106, 602 as in FIG. 5 or 8, a protruding plate-based structure 26 (also referred to herein as a capillary pedestal) can be used as in FIGS. 3 and 4.

In other embodiments (not shown), when the capillary recess includes a complex pattern or shape, one portion of the shape may be configured for placement of the wick holder assembly, for example, at the head of an animal-shaped depression or at a predetermined point in some other feature to provide an artistic and/or aesthetically pleasing effect. In this way, the placement of one or more wick holder assemblies may form part of a design incorporating the melting plate surface and/or one or more capillary recesses. The capillary recess and capillary base may also be shaped to have only one operative fit to facilitate proper insertion of the capillary base into the capillary recess.

As shown in FIGS. 10A-10D, melting plates 400, 402, 404, and 406 have capillary recesses 408, 410, 412, and 414, respectively, which may vary by size, depth, and/or surface feature, such as, for example, a flat bottom, a terraced bottom, a dimpled surface, and/or a ribbed surface. Capillary recesses contemplated herein may also vary by peripheral shape, profile, number, and how they interface with the wick holder assembly. For example, a capillary recess when viewed from above may have other shapes (not shown), such as a character or symbol, as in a logo, a letter, and/or a number, for example. Further, complex designs may be utilized such as animal outlines, three dimensional shapes, and/or any other artistic features. For example, FIGS. 10A-10D illustrate different capillary recesses 408, 410, 412, and 414 that vary by depth (measured from a bottom surface 80 of the capillary recess to an upper most portion of the capillary recess wall 82), width (measured from the upper most portion of the capillary recess wall 82 on one side of the capillary recess to an opposing portion 86 on the opposite side of the capillary recess), profile (for example, flat, curved, pointed, or complex, such as terraced, waved, and the like), and/or peripheral shape. Converse shapes for the receiving structure of the melting plate (generally, capillary pedestals) for the wick assembly are contemplated as well.

Figure 11A:
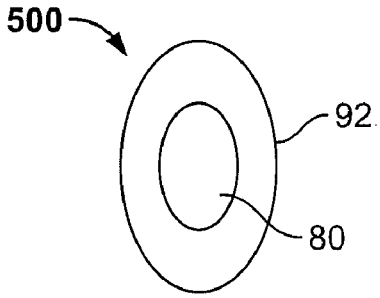
FIGS. 11A-11H are plan views of capillary depressions of different configurations.
Figure 11B:
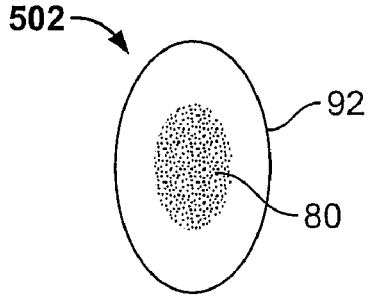
Figure 11C:
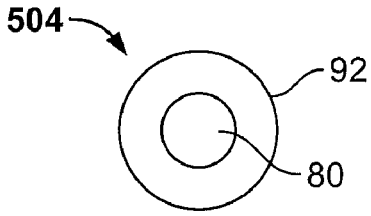
Figure 11D:
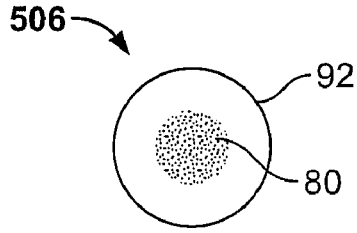
Figure 11E:
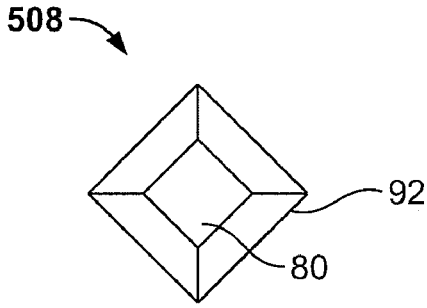
Figure 11F:
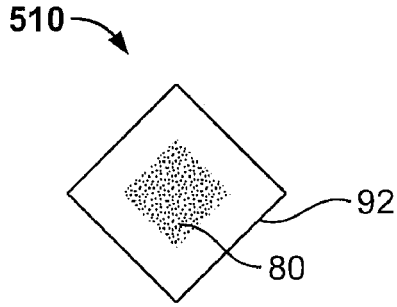
Figure 11G:
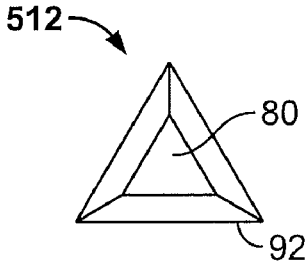
Figure 11H:
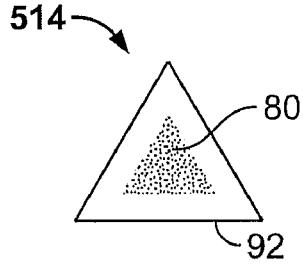

FIGS. 11A-11H illustrate several capillary recesses and capillary pedestals of various shapes that can be utilized with the various melting plates disclosed herein and variations thereof. For purposes of brevity, a capillary recess will be discussed with the understanding that complementary structure can be used for a capillary pedestal (for example, a concave bottom surface versus a convex top surface). Each of the capillary recesses 500 and 502 of FIGS. 11A and 11B, respectively, has an oval-shaped periphery 92, though the bottom surface 80 of FIG. 11A is flat, and the bottom surface 80 of FIG. 11B is rounded or curved. Similarly, the capillary recesses 504, 508, and 512 shown in FIGS. 11C, 11E, and 11G have flat bottom surfaces 80 and circular, square, and triangular peripheries 92, respectively. Further, the capillary recesses 506, 510, and 514 of FIGS. 11D, 11F, and 11H have rounded or curved bottom surfaces 80 and circular, square, and triangular peripheries 92, respectively. Other peripheral shapes (not shown) for the capillary recesses contemplated herein may also be used, such as symbols or irregular shapes depicting one or more caricatures, provided that the complementary convex capillary base for such capillary recess is adequately shaped to form a capillary space, for example, between a bottom of the capillary recess and the convex capillary base in question.

Figure 12:
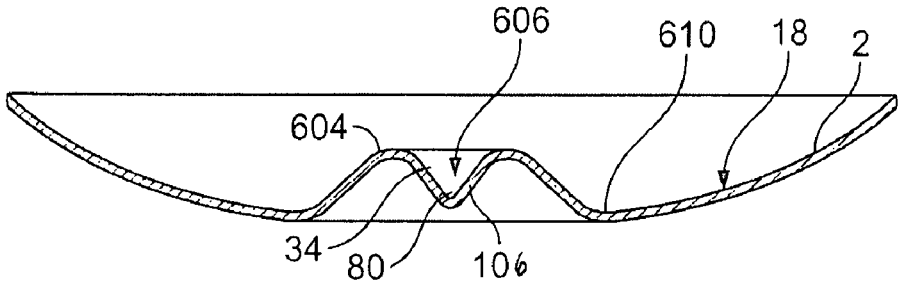
FIG. 12 is a cross-sectional view of a melting plate with a capillary depression according to another embodiment.
Figure 13:
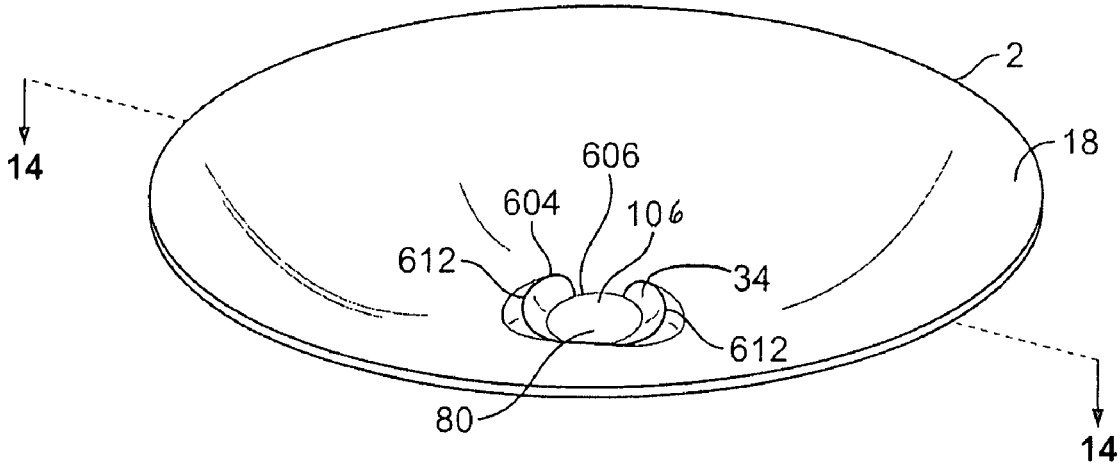
FIG. 13 is an isometric view of a melting plate with a capillary depression according to a further embodiment.
Figure 14:
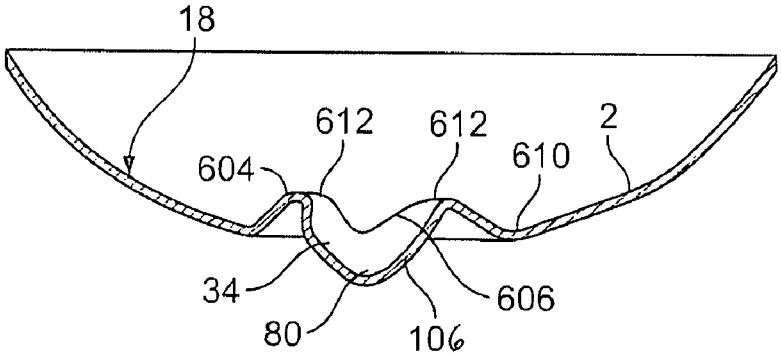
FIG. 14 is a cross-sectional view along lines 14-14.

FIGS. 12-14 illustrate further embodiments of a melting plate 2 having a capillary recess 106 with elevated side walls 604 divided by a furrow 606 that enables fluid communication between the melting plate and the bottom surface 80 of the capillary recess. In FIG. 12, the bottom surface 80 of the capillary recess is elevated above a top surface 610 of a surrounding portion of the melting plate 2, which leaves an unconsumed amount of fuel below the bottom surface of the capillary recess 106 when the flame extinguishes. A wick holder assembly, such as those shown in FIGS. 7-9, may be placed in the furrow 606, and the elevated side walls 604 help to secure the wick holder assembly to the melting plate 2 to reduce the chance of the wick holder assembly being disrupted when the melting plate candle is jarred. The elevated side walls 604 in combination with the wick holder assembly provide a capillary space (not shown) by which liquid fuel may be transferred to the wick (not shown) in a manner similar to that already described.

FIGS. 13 and 14 show a variation of the capillary recess 106 shown in FIG. 12, in which the bottom surface 80 of the capillary recess is depressed below the top surface 610 of a surrounding portion of the melting plate 2 such that melted fuel on the melting plate can be consumed. A pair of ridges 612 along an upper inner peripheral portion of the side walls 604 engages onto or over a convex capillary base (for example, see the convex capillary base 200 of FIG. 7) to hold the convex capillary base in an upright position within the capillary recess 106.

Figure 15A:
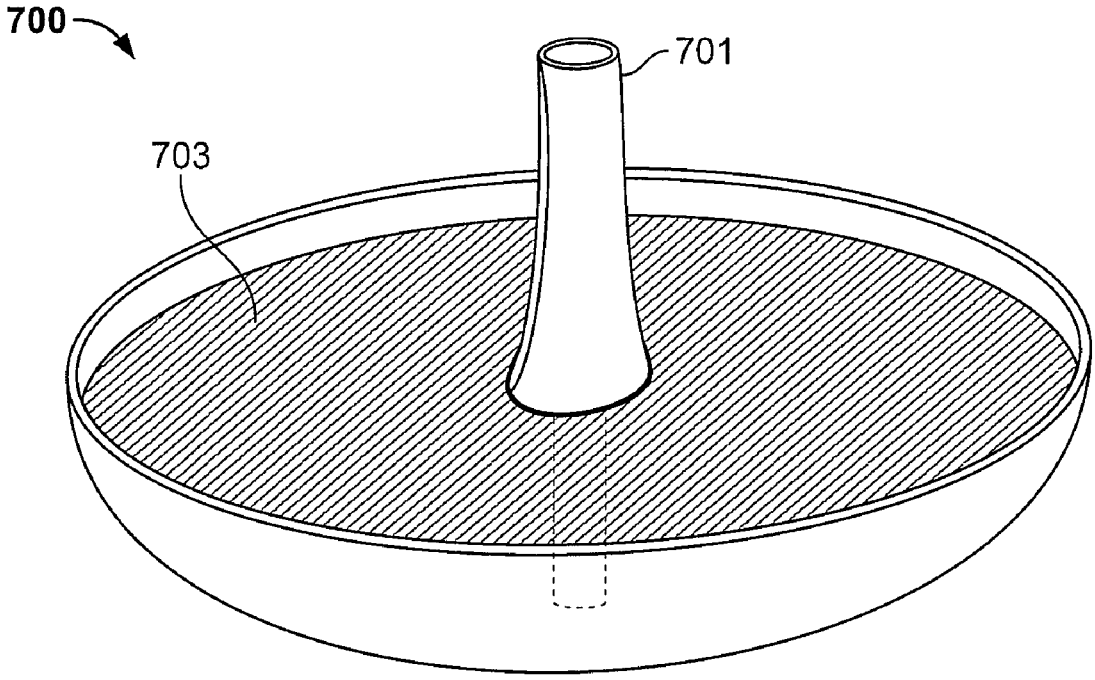
FIGS. 15A and 15B are inverted and right-side up views, respectively, of an alternative embodiment wherein the capillary base forms a mushroom shape.
Figure 15B:
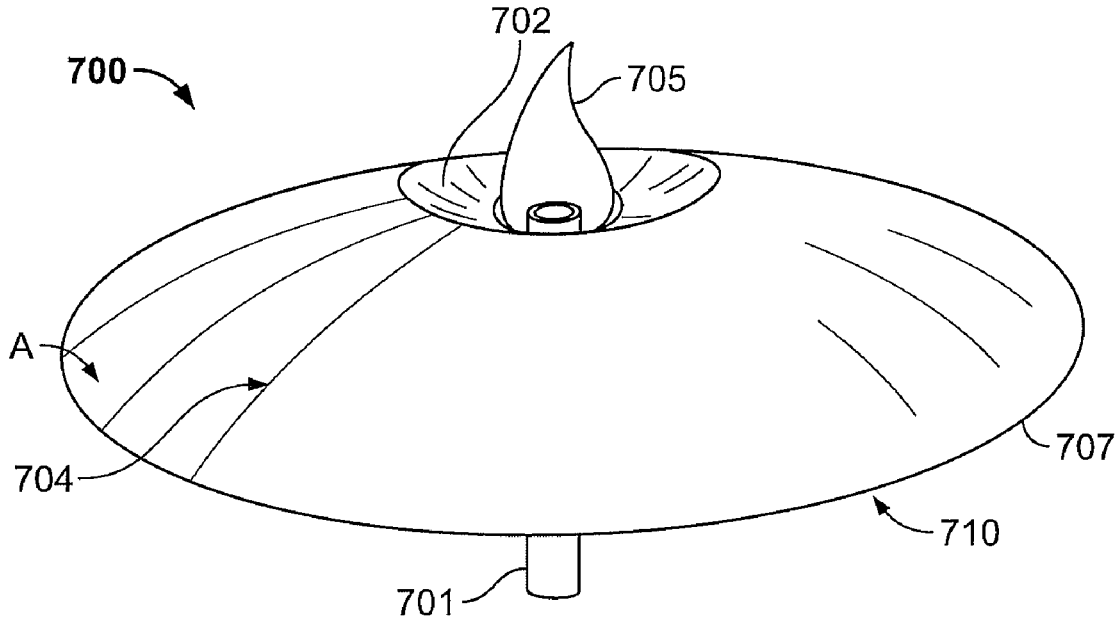

In yet another embodiment, illustrated in FIGS. 15A and 15B, the wick holder assembly 700 preferably includes a peg 701 that extends from the top of the underside of the capillary base 710 to beyond a plane that is defined by the edge 707 thereof. The proximal portion of the peg 701 relative to the capillary base is located in a cavity that opens to the top side of a melting dish (not shown), such that the aforementioned edge 707 rests on the melting dish. The wick holder assembly includes one or more attachment sites for one or more wicks (not shown), as desired; the bottom of the wick(s) (not shown) are in contact with the bottom-most portion of the top reservoir 702. Preferably, the wick assembly also includes one or more heat fins (not shown), a top reservoir 702, a bottom reservoir 703, and one or more capillary channels 704. The capillary channels may be ridges carved into the upper surface of the capillary base 710, or, in another embodiment, may be hollow cylinders or other-shaped hollow conduits by which melted fuel may flow to the upper reservoir.

Unmelted but meltable fuel is stored preferably in the bottom reservoir 703. An amount of fuel (unmelted but meltable) is also placed in the top reservoir 702. When the wick (not shown) is lit and a flame 705 is disposed thereupon, there is enough additional fuel present in the top reservoir for the flame to heat the wick holder assembly. At least some of the fuel located in the bottom reservoir then melts and flows out from under the edge 707 of the wick holder assembly 700, thus engaging the edge 707. In a preferred embodiment, the wick holder assembly 700 includes capillary channels 704, in which case the melted fuel engages one end of the capillary channels. Accordingly, the melted fuel flows up the wick assembly 700 by capillary action and collects in the top reservoir 702. The melted fuel in the top reservoir contacts the bottom portion of the wick, travels up the wick until it is consumed by the flame 705.

Melted fuel that emerges from the edge 707 of the capillary top can also flow back toward the peg 701. The peg 701, in one embodiment, includes a hollow longitudinal bore that extends from its distal end up to its proximal end where it connects to the underside of the capillary base 710. Further, the capillary base 710 includes an aperture at or toward the base of the upper reservoir 702 such that the hollow bore of the peg 701 is continuous with the aperture of the capillary base top surface. The distal portion of the peg 701 that extends beyond the plane defined by the capillary base edge 707 is preferably seated in a capillary recess (not shown), thereby forming a capillary space.

Operationally, the melted fuel flows toward the top of the capillary recess where the inlet for the capillary space is. The melted fuel then flows down the capillary space to the bottom surface of the capillary recess at the point of the outlet from the capillary space. The melted fuel can then do an about-face at the bottom edge of the peg 701 and flow up the longitudinal bore of the peg up to the upper reservoir. At the upper reservoir, the bottom region of the wick is preferably in contact with the melted fuel that transited through the peg bore, then up the wick to be consumed by the flame.

The various melting plates and wick holder assemblies described herein can also be used with other wick assemblies and melting plates, respectively, such as those disclosed in U.S. patent application Ser. No. 10/978,744, which is hereby incorporated in its entirety by reference.

INDUSTRIAL APPLICABILITY

In many embodiments, the candles disclosed herein may allow a candle to completely consume a wax fuel charge while maintaining the candle flame at the top of the wick holder, thereby maintaining a pre-selected height above the bottom of the melting plate. The candles may also rapidly form a large pool of melted wax or heated liquified fuel that accelerates dispersion of volatile materials contained in the fuel into the surrounding environment.

What is claimed is:

1. A candle comprising:

a. a plate having a first surface on a top side thereof, wherein the first surface defines a capillary recess;

b. a wick holder assembly having a wick and a capillary base, the capillary base comprising a convex second surface on a bottom side thereof that is complementary to the first surface and is disposed inside the capillary recess, wherein the wick has a top region and a bottom region;

c. fuel; and d. a capillary space formed between the first surface and the second surface, wherein the capillary space has an inlet side and an outlet side and the outlet side is at an outer peripheral edge of the second surface;

wherein the inlet side of the capillary space is proximate to the fuel and the outlet side of the capillary space is proximate to the bottom region of the wick; and wherein the capillary base comprises a bottom reservoir comprising a cavity in the capillary base and a lower aperture that provides fluid communication between the inlet side of the capillary space and the cavity.

2. The candle of claim 1, wherein the fuel enters the wick via its bottom region.

3. The candle of claim 1, wherein the first surface and the second surface releasably lock together.

4. The candle of claim 3, wherein the capillary base comprises an upper reservoir disposed above the bottom reservoir.

5. The candle of claim 1, wherein the plate comprises a heat-conducting material.

6. The candle of claim 5, wherein the plate further comprises an insulating space disposed between the heat-conducting material and a support base.

7. The candle of claim 1, wherein the wick holder assembly further comprises a heat fin for transmitting heat.

8. The candle of claim 1, wherein the fuel is located adjacent the wick holder assembly and the wick holder assembly further comprises an aliquot of additional fuel proximate to the top region of the wick.

9. The candle of claim 8, wherein at least some of the fuel enters the inlet of the capillary space, is transported to the outlet thereof, and contacts the bottom region of the wick.

10. The candle of claim 1, wherein the bottom reservoir includes an upper aperture through which the wick is disposed inside the bottom reservoir.

11. The candle of claim 1, wherein the plate and the wick holder assembly each comprise a heat conductive material, wherein the plate has a self-cleaning coating, and wherein the meltable fuel charge comprises a volatile material.

12. The candle of claim 11, wherein the wick holder assembly is ringed with one or more meltable fuel charges.

13. The candle of claim 11, wherein the volatile material comprises at least one of the group consisting of a fragrance, an air freshener, a deodorizer, an odor eliminator, an odor counteractant, an insecticide, an insect repellant, a herbal extract, a medicinal substance, a disinfectant, a sanitizer, a mood enhancer, and an aroma therapy composition.

14. A candle comprising:

a plate having a first surface;

a wick holder assembly having a wick and a capillary base, wherein the wick has a top region and a bottom region, the capillary base comprising a second surface that is complementary to the first surface, and the capillary base comprising an upper reservoir in fluid communication with the wick;

fuel; and a capillary space formed between the first surface and the second surface, wherein the capillary space has an inlet side and an outlet side and the outlet side is at an edge of the second surface;

wherein the inlet side of the capillary space is proximate to the fuel and the outlet side of the capillary space is proximate to the bottom region of the wick; and wherein the capillary base has a concave bottom that is substantially complementary to a capillary recess and further includes a peg that inserts into the capillary recess, thereby creating a capillary space, wherein the peg has a longitudinal bore through its interior that places the upper reservoir in fluid communication with the bottom of the capillary recess.

15. A candle comprising:

a. a plate having a first surface that defines a recess on a top side thereof, wherein the plate comprises a heat-conducting material and an insulating base portion;

b. a wick holder assembly having a wick and a capillary base that includes at least part of a second surface on a bottom side thereof that is complementary to the first surface and disposed in the recess, wherein the wick has a top region and a bottom region and the capillary base is configured to include a bottom reservoir and a top reservoir;

c. meltable fuel; and d. a capillary space formed between the first surface and the second surface, wherein the capillary space has an inlet side and an outlet side and the outlet side is at an edge of the second surface;

wherein the inlet side of the capillary space is proximate to the meltable fuel and the outlet side of the capillary space is proximate to the top reservoir, and the bottom region of the wick contacts the top reservoir.

* * * * *